US005371984A

United States Patent [19]

Taylor et al.

[11] Patent Number: 5,371,984

[45] Date of Patent: Dec. 13, 1994

[54] TOMBSTONE WITH CELLS FOR INTERRING URNS

[76] Inventors: Ernest W. Taylor, P.O. Box 414, Ashfield, Mass. 01330;

[21] Appl. No.: 218,190

[22] Filed: Mar. 28, 1994

[51] Int. Cl.[5] ..... E04H 13/00

[52] U.S. Cl. ..... 52/103; 52/136; 27/30; 40/124.5

[58] Field of Search ..... 52/103, 604, 610, 136, 52/133-135, 137; 27/30; 40/124.5

[56] References Cited

U.S. PATENT DOCUMENTS

| | | | |
|---|---|---|---|
| 2,095,290 | 10/1937 | Roy | 52/103 X |
| 2,525,091 | 10/1950 | Brownawell | 52/103 |
| 3,726,052 | 4/1973 | Thompson | 52/103 |
| 3,754,805 | 8/1973 | Pangburn | 312/111 |
| 3,925,944 | 12/1975 | Pickel | 52/136 X |
| 3,990,198 | 11/1976 | Ortutay | 52/136 |
| 4,463,527 | 8/1984 | Schlosser | 52/103 |
| 4,521,999 | 6/1985 | Flanagan | 52/103 |

FOREIGN PATENT DOCUMENTS

| | | | |
|---|---|---|---|
| 2608199 | 6/1988 | France | 52/128 |

*Primary Examiner*—Carl D. Friedman
*Assistant Examiner*—Beth A. Aubrey
*Attorney, Agent, or Firm*—Alden J. Gray

[57] ABSTRACT

A two piece tombstone monument cut with a matching tongue and groove. Removed segments of the tongue provide cells for interring urns or other containers of cremains.

3 Claims, 3 Drawing Sheets

TOMBSTONE WITH CELLS FOR INTERRING URNS

BACKGROUND

The present invention relates to masonry tombstones, and in particular, a stone monument that both marks a grave and acts as a vault to hold urns of ashes or cremains.

Normally tombstones are solid stone with one or more faces polished and etched. Little else is done to the stone and they last for centuries without maintenance.

Urns holding ashes from cremations are frequently buried near the tombstone. Information on their location should be accurately logged on detailed and precise maps, but frequently the maps are wrong, lost, or not consulted when the plot must be opened again for relatives who die later, and then the urns may be disturbed or even broken.

Many cemeteries have nearly used all available space for burials of vaults and caskets, but have space with shallow bedrock or heavy tree root growth that are restricted to interring cremains which may be buried at any depth. Also, areas where the ground freezes, burials may only be done during warm months. In these areas, a monument as of the present invention is desirable to reduce the amount of digging required. If the base is set into the ground, one hole one time is necessary. If the base is set on top of the ground, no digging is necessary, and the plot could be on bedrock.

U.S. Pat. No. 3,726,052 issued to Thompson Apr. 10, 1973, discloses a cemetery monument base that holds urns, but it is made of stainless steel and concrete. As our crumbling highway bridges attest, stainless steel and concrete will not endure time as well as stone, as in the Roman aqueducts and Pharaoh's pyramids.

Drilling holes or cells in solid rock bases is difficult and frequently cracks or breaks the stone, and it is not known that such holes have ever been used for inferring cremains. Drilled cavities also can fill with water since access is from the top and any drilled drain hole may get plugged with soil clays or the actions of worms. The cells in the present invention, however are made with a standard stone saw normally used to cut out the block itself, and any water that enters and condenses can exit by the same bottom side path by which it may have entered.

SUMMARY OF THE INVENTION

The tombstone of the present invention may be made from a single block of quarried stone, preferably mica garnet schist but may be any monument stone. The block is cut in two and a tongue and groove are sawed into the mating surfaces. The base with the tongue is cross cut, removing segments to make cells in the tongue. When the top part is replaced over the base, the cells will be closed and secure from the elements. The top stone can be easily made heavy enough to withstand vandals, and be removable with proper equipment to allow access for interring additional urns.

For larger families, each base could act as a top lot a previous base thereby providing multiple layers of cells. Each generation could have a new layer, and the plot capacity would only be limited by reasonable monument heights.

An object of the invention is to provide a long lasting monument aesthetically compatible with old cemeteries and that can be made with standard stoneworking equipment.

Another object is to provide protection for cremation urns from hazards of being disturbed, broken, or lost.

Still another object is to provide cremains burial means that can be accomplished easily even if the ground still has deep frost, has shallow bedrock, or has other restrictions of digging.

DESCRIPTION OF THE PREFERRED EMBODIMENT

Figure 1:
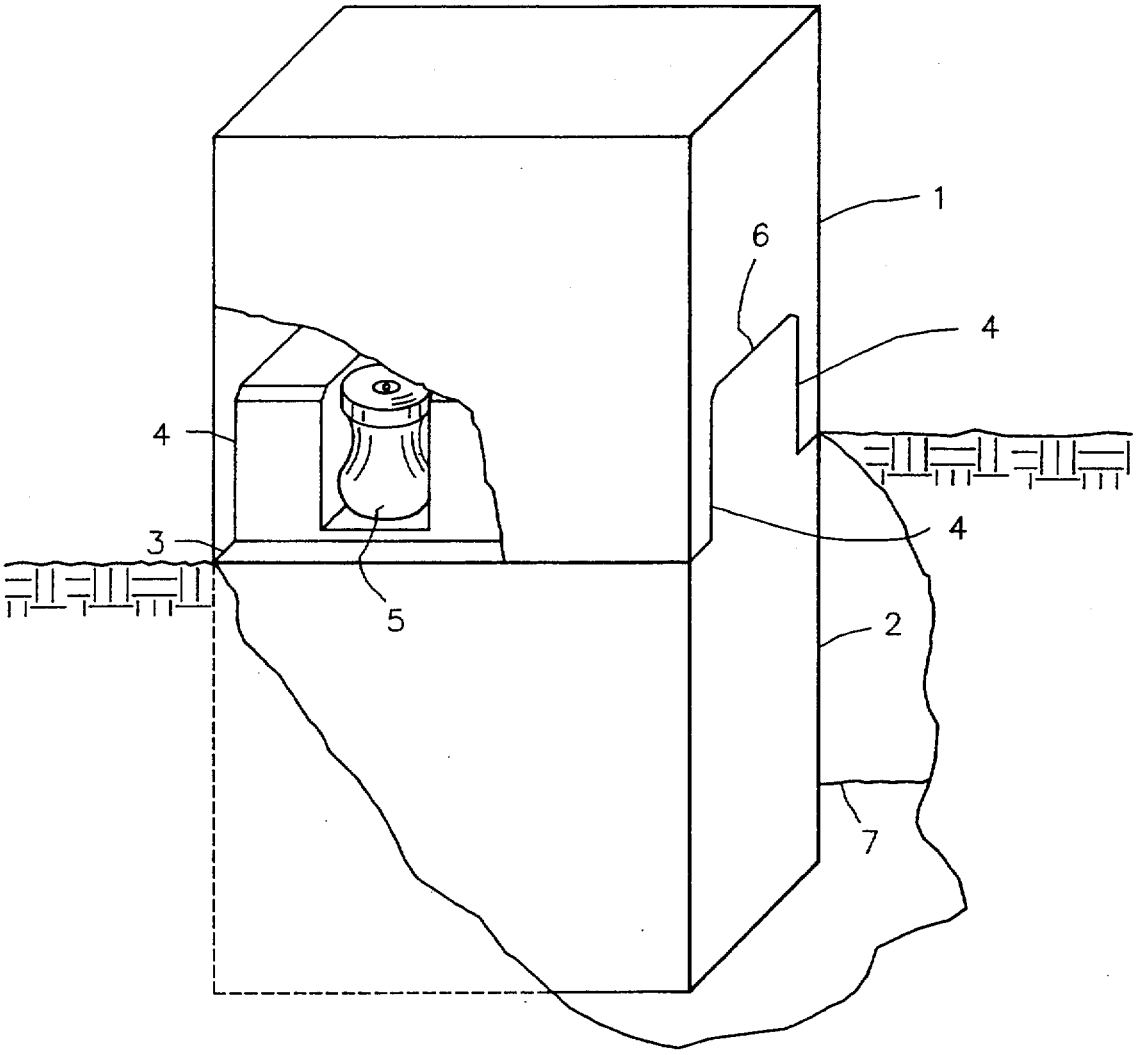
FIG. 1 is a pictorial showing the assembled tombstone. A tear away view shows the base in the ground and another tear away shows an urn in its cell.

In FIG. 1, the tombstone of the present invention is shown with the monument top 1 assembled to the base 2. Base 2 is preferably set into the ground deeply enough to extend below the usual maximum frost line 7 to prevent the stone from being jacked or tipped by the frost. In some cemeteries, however, where digging is difficult, the base may be set directly on top of the soil. Relative heights of the base and top can obviously be varied to suit the customer, site, and other conditions. Base 2 may also be additionally cut into a sub-top 1*a* and a sub-base 2*a* of like mating construction as top 1 and base 2 with additional cells therein. Such subdivision could continue providing any number of levels.

Figure 2:
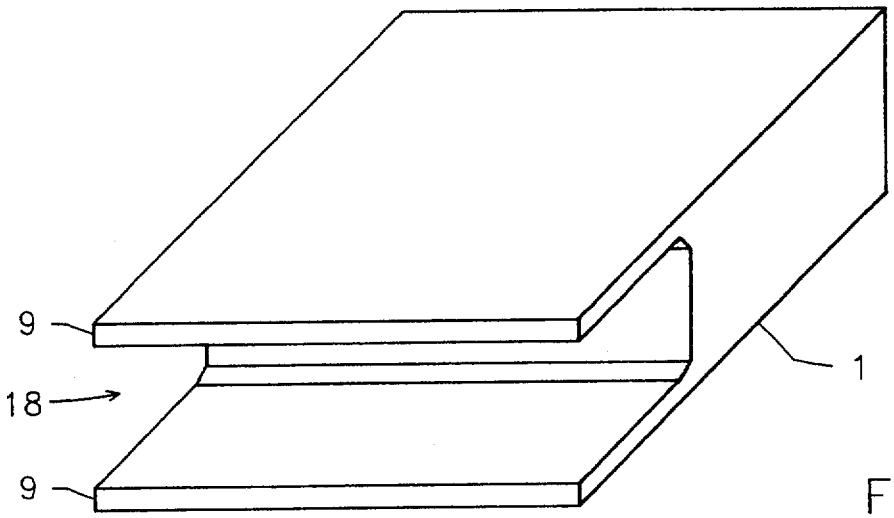
FIG. 2 is a pictorial showing the top section of the tombstone separated from the bottom section.
Figure 3:
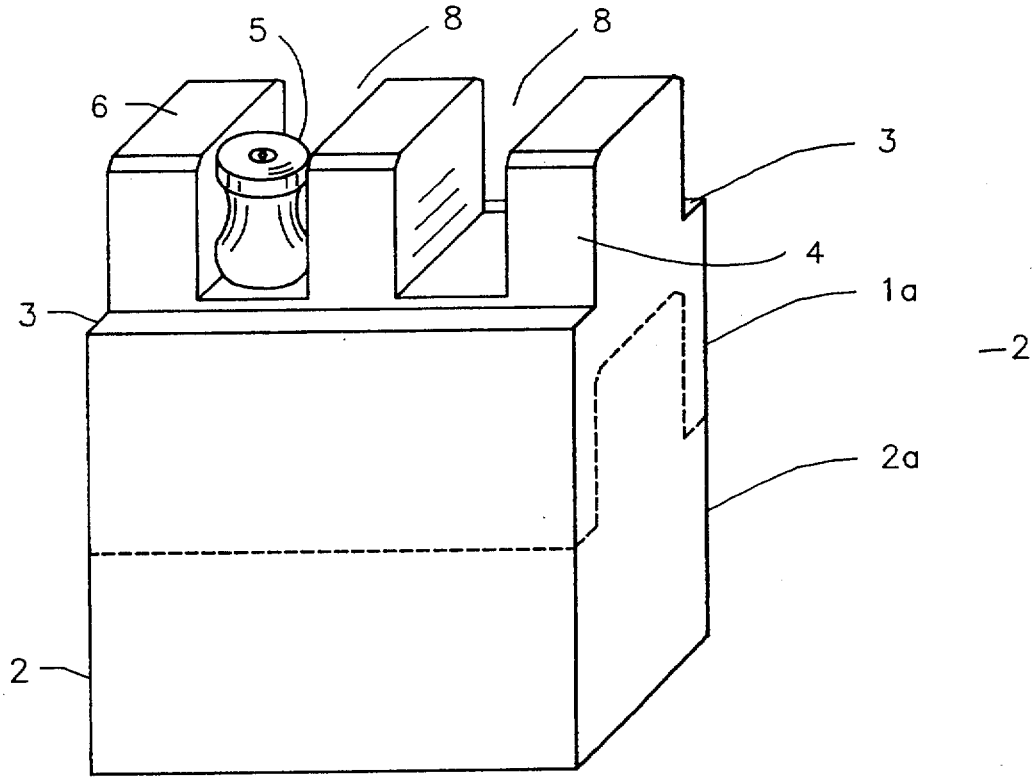
FIG. 3 shows the bottom section with cells open.
Figure 4:
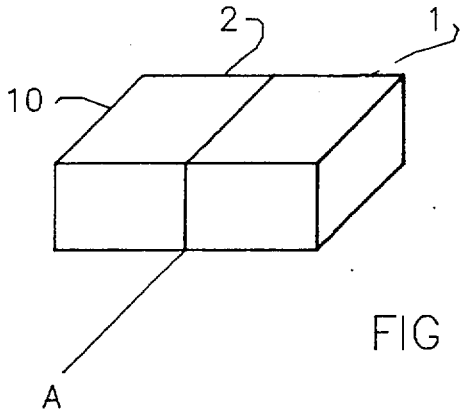
FIG. 4 is a first stage in a sequence of drawings showing progressively representative cuts which may produce the novel tombstone from a block.
Figure 5:
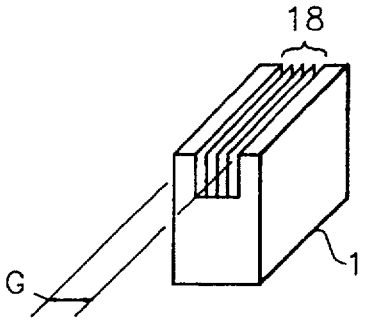
FIGS. 5 through 8 show additional stages in producing the tombstone.
Figure 6:
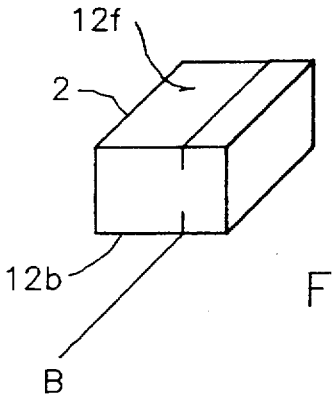
Figure 7:
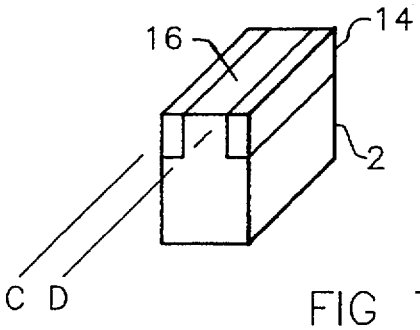
Figure 8:
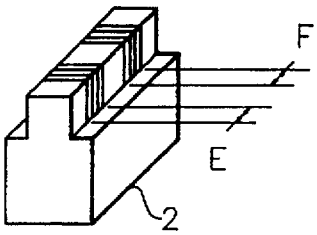

The monument top 1 may be lifted off the base 2, FIGS. 2 and 3, which exposes multiple cells 8 and any cremains containers 5. Urns or other cremains containers 5 may be added anytime as necessary. When the cells 8 are full, a sealing material such as a waterproof epoxy, could be put on surfaces 3, 4, and 6, but would not normally be necessary for the security of the cremains containers 5.

FIGS. 4 through 8 show a sequence of cuts that may produce a monument of the present disclosed invention. A block of stone is first cut through at A to make a base 2 and a monument top 1. This first cut also makes a first base surface 6 and a first top surface 9. Then kerfs cut on the base front 12*f* and the base back 12*b* of base 2 at B, a plane nearly parallel to first base surface 6, form second base surfaces 3. Third base surfaces 4 are formed by a cut at C and another at D, planes which intersect first base surface 6 and second base surfaces 3, and waste stone pieces 14 can be removed leaving a tongue 16 bounded by said surfaces 4 and 6. Cells 8 are then made by multiple cross cuts through the tongue 16 at E, planes perpendicular to both surfaces 4 and 6. Additional cells as desired may likewise be cut as at F. The matching top groove 18, sized to fit over tongue 16, may be formed by multiple longitudinal cuts in the first top surface 9 as at G, planes nearly perpendicular to first top surface 9, nearly parallel to and generally central between top front surface 11*f* and back top surface 11*b*. The depth of top groove 18 should match the height of tongue 16 and be a little greater than the height of cremains containers 5.

I claim:

1. A tombstone monument comprising a base, a monument top mounted on and supported by said base, said base having a tongue, an upwardly extending tongue, said tongue having portions removed to form at least one cell adequate to accept cremains' containers such as urns and boxes, and said monument top having a groove to match said tongue such that when said monument top is mounted on said base, said groove fits over and closes said at least one cell.

2. The tombstone monument of claim 1 wherein said base and said monument top are cut from a block of stone.

3. The tombstone of claim 1 wherein said base is formed to act as said top for another underlaying similarly formed base.

* * * * *